United States Patent [19]

Griffin

[11] Patent Number: 4,471,623

[45] Date of Patent: Sep. 18, 1984

[54] COMBUSTION CHAMBER FLOATWALL PANEL ATTACHMENT ARRANGEMENT

[75] Inventor: Christopher J. Griffin, Las Vegas, Nev.

[73] Assignee: The United States of America as represented by the Secretary of the Air Force, Washington, D.C.

[21] Appl. No.: 434,647

[22] Filed: Oct. 15, 1982

[51] Int. Cl.[3] ..... F23R 3/20

[52] U.S. Cl. ..... 60/752; 60/39.31

[58] Field of Search ..... 60/39.31, 39.32, 752, 60/753, 755, 756, 757, 758, 759, 760

[56] References Cited

U.S. PATENT DOCUMENTS

| | | | |
|---|---|---|---|
| 2,651,912 | 9/1953 | Abbott | 60/755 |
| 2,760,338 | 8/1956 | Keast | 60/39.36 |
| 2,813,397 | 11/1957 | Fisher et al. | 60/39.32 |
| 2,988,886 | 6/1961 | Hamm et al. | 60/39.65 |
| 3,520,134 | 7/1970 | Cripe et al. | 60/39.69 |
| 4,149,373 | 4/1979 | Jones et al. | 60/39.32 |
| 4,302,932 | 12/1981 | Kuznetsov et al. | 60/39.32 |

FOREIGN PATENT DOCUMENTS

| | | | |
|---|---|---|---|
| 2713414 | 9/1978 | Fed. Rep. of Germany | 60/39.32 |
| 1487064 | 8/1974 | United Kingdom | 60/39.32 |

*Primary Examiner*—Louis J. Casaregola
*Assistant Examiner*—Timothy S. Thorpe
*Attorney, Agent, or Firm*—Donald J. Singer; John R. Flanagan

[57] ABSTRACT

An attachment arrangement in a combustion chamber of a gas turbine powerplant, having a double wall structure formed by a separate combustor shell and at least one floatwall panel, includes a pair of hook-like projections protruding from the panel and through the shell and a pair of thin plates for interengaging the hook-like projections on one side of the shell opposite to the other side thereof which faces the panel. Each of the hook-like projections has an outer portion spaced from the one side of the shell and extending generally parallel thereto. Each of the plates is tapered in cross section for adapting each plate to be fitted in a wedged condition between the outer portion of one of the projections and the one side of the shell to retain the panel in a desired predetermined position adjacent to the shell. Also, the plates are rigidly connected to the shell and to one another.

4 Claims, 4 Drawing Figures

COMBUSTION CHAMBER FLOATWALL PANEL ATTACHMENT ARRANGEMENT

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to combustion chamber construction in a gas turbine engine and, more particularly, is concerned with an improved arrangement for attachment of floatwall panels to a floatwall combustor shell of the combustion chamber.

2. Description of the Prior Art

Gas turbine engines with combustion chambers having a variety of wall constructions are common in the prior art. U.S. Pat. to Keast, Nos. 2,760,338; Fisher et al, 2,813,397; Hamm et al, 2,988,886; Cripe et al, 3,520,134; Jones et al, 4,149,373; and Kuznetsov et al, 4,302,932 illustrate various wall constructions and attachment structures for coupling wall segments and/or sections together.

It is a common design objective to provide a combustion chamber construction which will permit relative thermal expansion between combustion chamber parts as they operate in their separate areas of substantially different temperatures. Keast, Fisher et al and Kuznestov et al have attachment features intended to allow for differential thermal expansion between combustion chamber parts.

Due to extreme operating temperatures existing in the region of the combustion chamber, certain of its parts usually have a shorter life span than others. In spite of efforts to cool such parts, frequent replacement is required. Consequently, another common design objective is to provide a combustion chamber which is easily accessible and permits easy assembly and dismantling. Keast and Hamm et al have attachment features intended to facilitate replacement of combustion chamber parts.

While the attachment features of the aforementioned patents may satisfactorily perform their intended functions in the specific applications for which they were designed, a need exists for an attachment arrangement having broader, more generalized, application and utility.

SUMMARY OF THE INVENTION

The present invention provides an attachment arrangement for parts of a combustion chamber, such as the floatwall combustor shell and panels, which is designed to satisfy the aforementioned needs. The arrangement minimizes the number of parts required to provide the kind of attachment between the combustion chamber shell and panels which facilitates easy assembly and disassembly of the panels to and from the shell. At the same time, the arrangement permits the establishment of a looseness of fit between the panels and shell that is commensurate with the expected degree of relative thermal expansion between the combustion chamber parts.

Accordingly, the present invention is directed to an attachment arrangement in a combustion chamber of a gas turbine powerplant having a double wall structure formed by a separate combustion shell and at least one panel. The attachment arrangement includes means on the panel protruding therefrom through the shell, and means interengaging the protruding means on one side of the shell opposite to the other side thereof which faces the panel. The protruding means includes a pair of hook-like projections each of which has an outer portion spaced from the one side of the shell and extending generally parallel thereto. The interengaging means includes a pair of thin plates each of which is tapered in cross section for adapting each plate to be fitted in a wedged condition between the outer portion of one of the projections and the one side of the combustor shell to retain the panel in a desired predetermined position adjacent to the shell. The plates are also rigidly connected to the shell, such as by welds.

DETAILED DESCRIPTION OF THE INVENTION

Figure 1:
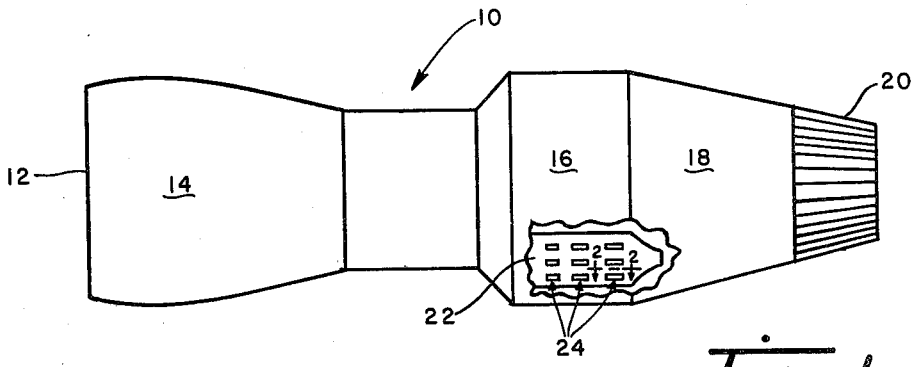
FIG. 1 is a side elevational view of a gas turbine engine with an outer wall portion broken away to expose part of one of a plurality of combustion chambers which incorporate in their construction the attachment arrangement of the present invention.

Referring now to the drawings, and more particularly to FIG. 1, there is shown a gas turbine powerplant, generally designated 10, which has an air inlet 12, a compressor section 14, a combustion section 16, a turbine section 18, and an exhaust section or duct 20.

The combustion section 16 is comprised of a plurality of combustion chambers 22, only one of which is shown in FIG. 1. While not necessarily so limited, powerplant 10 may use eight combustion chambers 22 equally spaced circumferentially about the centerline of the powerplant 10 and equidistant radially therefrom.

In its general mode of operation, air enters the powerplant 10 through air inlet 12, is compressed as it passes through the compressor section 14, is heated in a power generating function by the combustion chambers 22 of the combustion section 16, then passes through the turbine section 18 in a power extraction function, and, finally, is exhausted in jet exhaust fashion through the exhaust duct 20.

As readily apparent from consideration of the above-cited prior patents, considerable attention has been directed to various factors affecting combustion chamber construction in the past. One factor is that the various parts of each combustion chamber are at greatly different and varying temperatures and therefore substantial relative thermal expansion exists within and between the various parts. Also, as a result of these conditions, another factor is that some parts experience shorter service life than others and consequently require frequent maintenance and possibly replacement.

For accommodating these factors, an improved attachment arrangement, generally designated 24, is provided by the present invention. A plurality of such arrangements 24 are used to interconnect one or more inner floatwall panels 26 and an outer combustor shell 28 to form a double wall structure, generally designated 30, for the combustion chamber 22 of the gas turbine powerplant 10.

Figure 2:
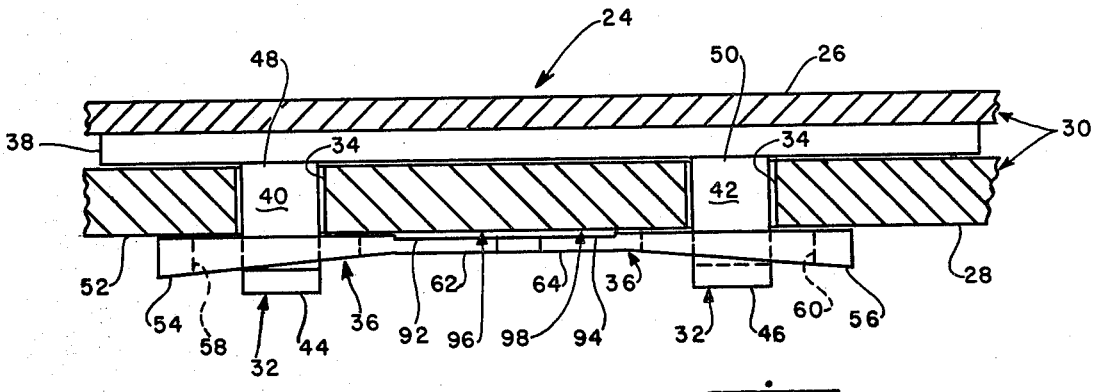
FIG. 2 is an enlarged fragmentary sectional view of the combustion chamber shown in FIG. 1 taken along line 2--2 therein in order to illustrate the attachment arrangement in fully assembled condition.

Turning now to FIG. 2, it can be seen that each attachment arrangement 24 is basically comprised of means, generally designated 32, on the panel 26 protruding therefrom and through holes 34 in the shell 28, and means, generally designated 36, interengaging the protruding means 32.

The protruding means 32 includes a flat ledge 38 on the panel 26 which spaces the panel 24 from the combustor shell 28 by a desired amount, and a pair of hook-like projections 40, 42 fixed to the ledge 38. Each hook-like projection 40, 42 has the configuration of an "L", the horizontal leg of which forms an outer portion 44, 46 of the projection 40, 42 and the vertical leg of which forms an inner portion 48, 50 which extends from the ledge 38 through the hole 34 in the shell 28. Each inner portion 48, 50 is of such a length that the corresponding outer portion 44, 46 is supported at a position parallel to the adjacent exterior surface 52 of the shell 28 but spaced therefrom by an amount sufficient to receive the intergaging means 36 therebetween.

The interengaging means 36 includes a pair of thin plates 54, 56 each of which is tapered in cross section. This adapts each plate 54, 56 to be fitted in a wedged condition between the outer portion 44, 46 of one of the projections 40, 42 and the exterior surface 52 of the combustor shell 28 to retain the panel 26 in a desired predetermined position adjacent to the shell 28. The plates 54, 56 have respective oval-shaped openings 58, 60 defined therein for receiving the outer portions 44, 46 of the hook-like projections 40, 42 therethrough. The elongated configuration of the openings 58, 60 allows the plates 54, 56 to be axially adjusted until the desired degree of looseness of fit between the panel 26 and shell 28 is met. Such axially adjusted conditions of the plates are referred to herein as their respective wedged conditions.

Figure 3:
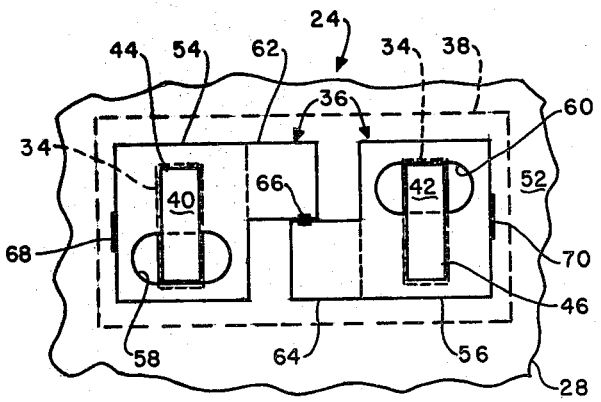
FIG. 3 is an enlarged fragmentary side elevational view of the combustion chamber of FIG. 1, showing the preferred form of the attachment arrangement.

Once the plates 54, 56 have been adjusted and fitted in their desired wedged conditions, tabs 62, 64 on the respective adjacent sides of the plates, in the preferred embodiment of FIG. 3, will interface with one another. This is so because the outer portions 44, 46 of the hook-like projections 40, 42, in the FIG. 3 embodiment, are parallel, but extend in generally opposite directions, while the plates 54, 56, which are generally identical, are disposed in a generally common plane but with one plate 56 disposed in upside down relation to the other plate 54.

In the above relationship the plates assume their wedged conditions by being forced in directions toward one another during the aforementioned adjustment of the degree of looseness of fit. This occurs once the panel 26 has been placed in a desired predetermined position along the shell 28. The plates 54, 56 are fixed in their wedged conditions by welding the tabs 62, 64 together at location 66 and also the edges of the plates 54, 56 to the shell 28 at locations 68, 70. With the plates so anchored to one another and to the shell, the panel 26 is retained in the desired position along the shell 28.

Figure 4:
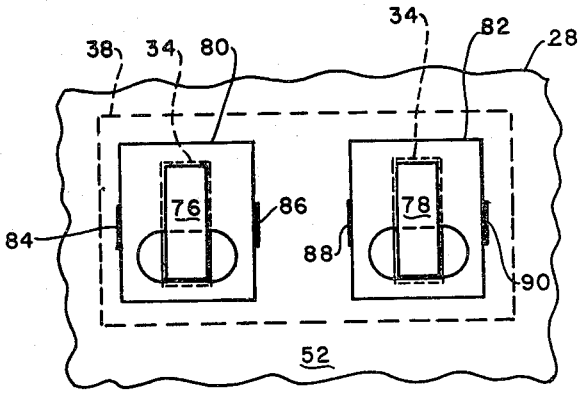
FIG. 4 is an enlarged fragmentary view similar to that of FIG. 3, but showing an alternative form of the attachment arrangement.

The alternative embodiment of FIG. 4 is generally similar to the preferred embodiment of FIG. 3. However, in FIG. 4 the outer portions 72, 74 of the hook-like projections 76, 78 extend in generally the same direction and the plates 80, 82 are identically interfitted between the outer portions 72, 74 and the exterior surface 52 of the shell 28. Also, in the alternative embodiment, the tabs of the plates 54, 56 in FIG. 3 have been omitted. Instead, both vertical edges of each plate 80, 82 are fixed to the shell 28 by welds 84, 86 and 88, 90.

The floatwall panel 26 is preferably constructed by casting which means that the hook-like projections may be formed in the casting operation as an integral part of the panel. This eliminates the possibility of having any fasteners exposed on the interior surface of the panel. It will also be noted that the weld connection between the tabs 62, 64 on plates 54, 56 can be inspected by X-raying due to the recessed tab surfaces 92, 94 facing the surface 52 of the shell 28 and which create gaps 96, 98 between the tabs and the shell. Furthermore, the particular attachment arrangement of the present invention does not require any welding directly to the hook-like projections on the panels. Therefore, the panel is more readily disassembled from the shell by merely destroying the welds connecting the plates 54, 56 to one another and to the shell than would be the case if the plates were welded directly to the hook-like projections 40, 42 on the panel 26.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. In a combustion chamber of a gas turbine powerplant having a double wall structure formed by a separate combustor shell and at least one floatwall panel, an attachment arrangement comprising:

(a) means on said panel protruding therefrom and through said shell;

(b) means interengaging said protruding means on one side of said shell opposite to the other side thereof which faces said panel;

(c) said protruding means including a pair of hook-like projections each of which has an outer portion spaced from said one side of said shell and extending generally parallel thereto, said outer portions also extending in generally parallel relationship to one another and in generally opposite directions;

(d) said interengaging means including a pair of thin plates each of which is tapered in cross section, points in opposite directions toward one another and is disposed in forced-fitted, wedged condition between each said outer portions of said respective hook-like projections and said one side of combustor shell, said thin plates being further disposed in upside-down relation to one another in their respective wedged conditions and being rigidly connected together so as to oppose movement of one another away from their respective wedged conditions and thereby retain said panel in a desired predetermined position adjacent to said shell; and (e) means rigidly connecting said plates of said pair thereof to said shell.

2. The attachment arrangement as recited in claim 1, wherein said protruding means includes a ledge on said panel which spaces said panel from said combustor shell.

3. The attachment arrangement as recited in claim 1, wherein said thin plates have respective openings defined therein for receiving said outer portions of said hook-like projections therethrough precedent to fitting said plates in their said respective wedged conditions.

4. The attachment arrangement as recited in claim 5, wherein said plates are disposed in a generally common plane when fitted in said wedged condition.

* * * * *